US005529156A

United States Patent [19]

Yang

[11] Patent Number: 5,529,156

[45] Date of Patent: Jun. 25, 1996

[54] FRAME WORK FOR SOFT-SIDED LUGGAGE

[76] Inventor: Fu-Hsiung Yang, No. 11, Alley 7, Lane 148, Chung-shan Road, Sec. 2, Pan-Chiao City, Taiwan

[21] Appl. No.: 209,802

[22] Filed: Mar. 11, 1994

[51] Int. Cl.[6] ..... A45C 5/14; A45C 13/04; A45C 13/36

[52] U.S. Cl. ..... 190/122; 190/18 A; 190/127

[58] Field of Search ..... 190/18 A, 119, 190/122, 123, 127, 24

[56] References Cited

U.S. PATENT DOCUMENTS

| | | | |
|---|---|---|---|
| 2,716,473 | 8/1955 | Droutman | 190/119 |
| 4,418,804 | 12/1983 | Bradley et al. | 190/18 A |
| 4,433,760 | 2/1984 | Pelavin | 190/127 X |
| 4,610,333 | 9/1986 | Seynhaeve | 190/18 A |
| 4,762,211 | 8/1988 | Krenzel | 190/122 |
| 5,031,734 | 7/1991 | King | 190/122 |
| 5,115,895 | 5/1992 | Myers | 190/18 A |
| 5,181,590 | 1/1993 | Carpenter | 190/18 A |
| 5,197,579 | 3/1993 | Bieber et al. | 190/18 A |
| 5,253,739 | 10/1993 | King | 190/18 A |
| 5,358,082 | 10/1994 | Armstrong, IV | 190/127 X |

FOREIGN PATENT DOCUMENTS

| | | | |
|---|---|---|---|
| 2605197 | 4/1988 | France | 190/127 |
| 2680647 | 3/1993 | France | 190/18 A |
| 465585 | 3/1952 | Italy | 190/122 |
| 139570 | 3/1953 | Sweden | 190/119 |
| 79101150 | 2/1990 | Taiwan . | |
| 8301730 | 5/1983 | WIPO | 190/122 |

OTHER PUBLICATIONS

Publication #164855, Aug. 1, 1991, Corresponding U.S. Application Ser. No. 07/476,870 filed Feb. 8, 1990.

*Primary Examiner*—Sue A. Weaver

*Attorney, Agent, or Firm*—Merchant, Gould, Smith, Edell, Welter & Schmidt

[57] ABSTRACT

A frame work for soft-sided luggage comprises a U-shaped base structure that can be engaged with a U-shaped upper structure and/or a metal frame. The U-shaped upper structure or the metal frame serves to support a luggage configuration at the upper portion. The U-shaped base structure is provided with reinforcing ribs to increase the luggage rigidity, and also has wheel bases that can accommodate wheels for trailing the luggage. Guide grooves and guide bands are also provided on the U-shaped base structure to accommodate the metal frame when required. The U-shaped base and upper structures can be injection molded as standardized components that allow constructions of luggage with different structural configurations.

8 Claims, 6 Drawing Sheets

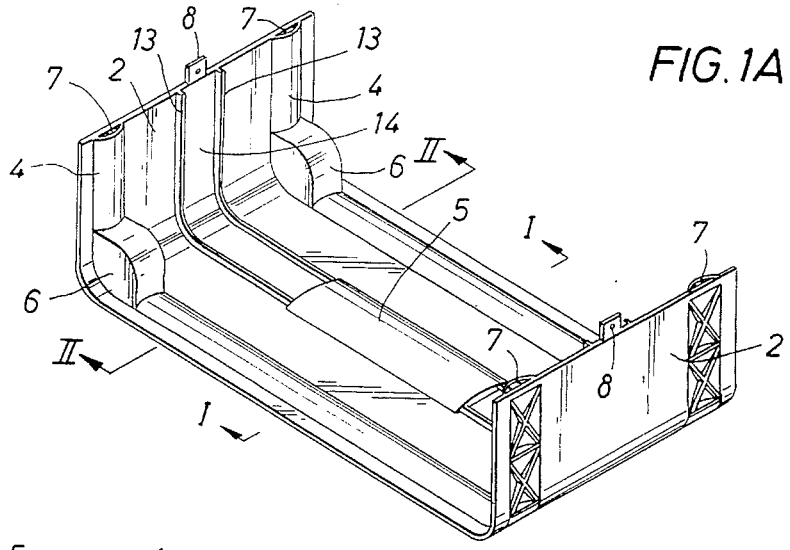
FIG. 1A
FIG. 1B
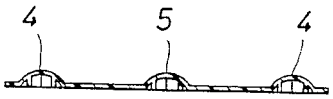
FIG. 2
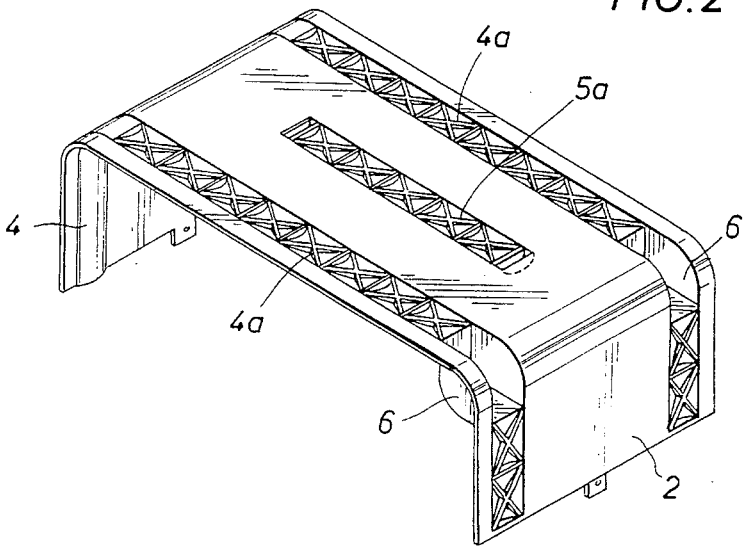
FIG. 3A
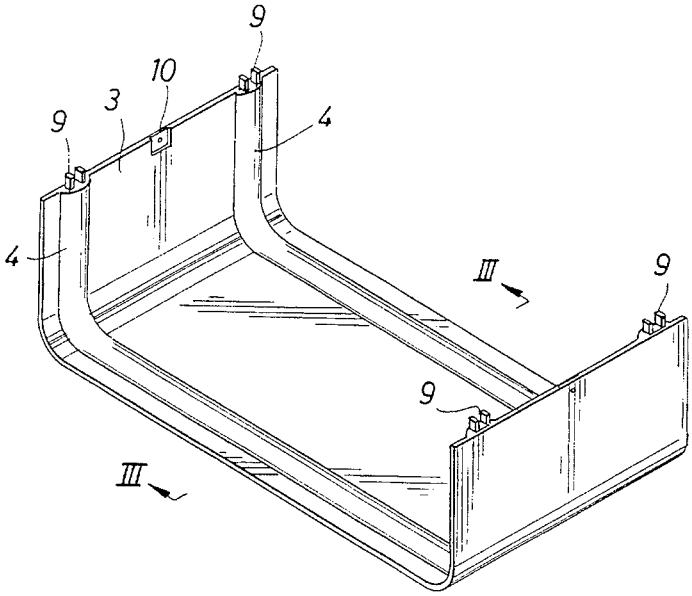
FIG. 3B
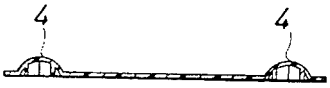

FRAME WORK FOR SOFT-SIDED LUGGAGE

BACKGROUND OF THE INVENTION

1. Field of the Invention

This invention relates in general to the frame work for soft-sided luggage. In particular, this invention relates to the frame work for soft-sided luggage that is soft and flexible for easy manufacturing and assembly, and is also light in weight and strong in resistance to structural distortion. More particularly, this invention relates to the frame work for soft-sided luggage with standardized structural component that allows constructions of luggage with different structural configurations.

2. Technical Background

The main body of conventional luggage is comprised of metal frame work paneled by polyvinyl chloride (PVC) plastic cloth or plywood plates paneled by polyvinyl chloride (PVC) plastic cloth. Edges of the luggage body are generally reinforced by steel wires, and rivets are required to secure the various components of the entire luggage body. Such a conventional luggage construction, although enjoys the advantages of being strong in resistance to structural distortion, however, metal frame work, the plywood planes, rivets and steel wires increase considerably the weight of the luggage. On the other hand, the complicated construction also renders the production cost relatively high and is difficult to be manufactured.

SUMMARY OF THE INVENTION

The object of the present invention, therefore, is to provide a frame work for soft-sided luggage that is light in weight and can provide strong structural strength against distortion.

It is another object of the present invention to provide a frame work for soft-sided luggage that is easy and inexpensive to be manufactured.

It is still another object of the present invention to provide a frame work for soft-sided luggage that is flexible in assembling and allows constructions of luggage in different configurations.

BRIEF DESCRIPTION OF THE DRAWING

The present invention, together with its features and advantages are described in the following paragraphs in accordance with preferred embodiments and the accompanied drawings, in which:

FIG. 1A is a perspective view of a U-shaped base structure in accordance with an embodiment of the present invention as viewed from inside the luggage;

FIG. 1B is a cross-sectional view taken along line I—I of FIG. 1A;

FIG. 2 is a perspective view of the U-shaped base structure of FIG. 1A as viewed from outside the luggage;

FIG. 3A is a perspective view of a U-shaped upper structure as viewed from inside the luggage;

FIG. 3B is a cross-sectional view taken along line III—III of FIG. 3A;

DETAILED DESCRIPTION

The present invention is best exemplified by a wheeled luggage embodiment in accordance with the present invention that is capable of configurational conversion.

Figure 1C:
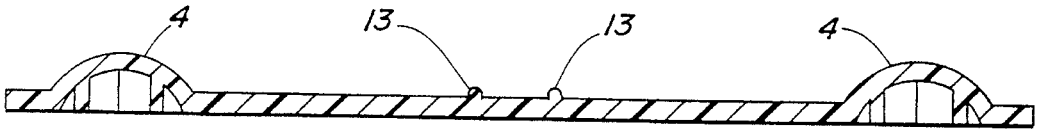
FIG. 1C is a cross-sectional view taken along line II—II of FIG. 1A.

Please refer to FIGS. 1A and 1B. The U-shaped base structure 2 is provided with one reinforcing rib 4 on each of the two side edges of its interior surface, and one reinforcing band 5 between and parallel to these two reinforcing ribs 4. Each of the reinforcing ribs 4 and reinforcing band 5 has a convex surface protruding toward the luggage interior, and has arc-shaped cross section, and serves as the primary measure for strengthening the rigidity of U-shaped base structure 2. One wheel base 6 is provided on each of the reinforcing ribs 4 at one corner of the U-shaped base structure 2 for receiving a wheel for trailing the luggage. Engaging holes 7 are provided at both ends of the two reinforcing ribs 4 for engagement with engaging latch rods 9 provided on U-shaped upper structure 3. One connecting lock tab 8 protruding at the center of each end of the U-shaped base structure 2 is further provided for engagement with the engaging notches 10 provided on U-shaped upper structure 3, and each of the connecting lock tabs 8 may be optionally provided with a rivet hole for rivet-engagement with each of the engaging notches 10. Two guide grooves 13 extending parallel to each other and also parallel to the reinforcing ribs 4 are provided to form one guide band 14 in the inner surface of the U-shaped base structure 2 at both ends of the reinforcing band 5.

Please refer now to FIG. 2, in which the U-shaped base structure 2 of FIG. 1A is shown as seen from the outside. Small rib plates 4*a* and 5*a* are provided at the back of the convex surface of reinforcing ribs 4 and reinforcing band 5 respectively for reinforcing purpose and can increase the rigidity of the U-shaped base structure 2.

Figure 4:
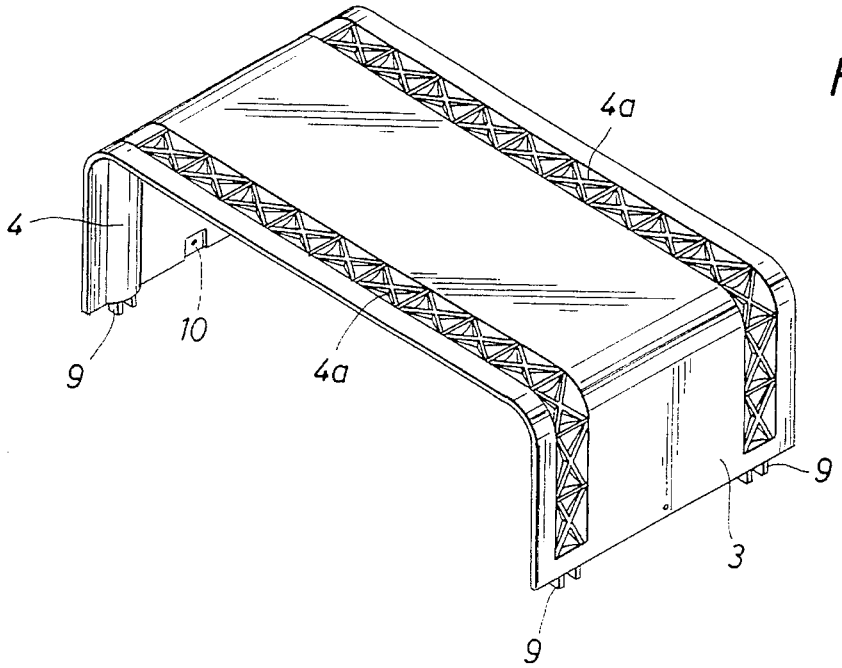
FIG. 4 is a perspective view of the U-shaped upper structure of FIG. 3A as view from outside the luggage.

As can be seen in FIGS. 3A, 3B and 4, a U-shaped upper structure 3 is provided to cooperate with the U-shaped base structure 2 to comprise the luggage frame work 1. Similar to the U-shaped base structure 2, the U-shaped upper structure 3 is also provided with one reinforcing rib 4 on each of the two side edges of its interior surface, and each of the reinforcing ribs 4 has a convex surface protruding toward the luggage interior, and has arc-shaped cross section, and serves as the primary measure for strengthening the rigidity of U-shaped upper structure 3. Small rib plates 4*a* are also provided at the back of the convex surface of reinforcing ribs 4 for reinforcing purpose and can increase the rigidity of the U-shaped upper structure 3. Engaging latch rods 9 are provided at both ends of the two reinforcing ribs 4 of the U-shaped upper structure 3 for engagement with the engaging holes 7 provided on U-shaped base structure 2. One engaging notch 10 is provided at the center of each end of the U-shaped upper structure 3 for engagement with the connecting lock tabs 8 provided on U-shaped base structure 2, and each of the engaging notches 10 may be optionally provided with a rivet hole that is exactly aligned with each of the rivet holes of the connecting lock tabs 8 for rivet-engagement therewith.

Figure 5:
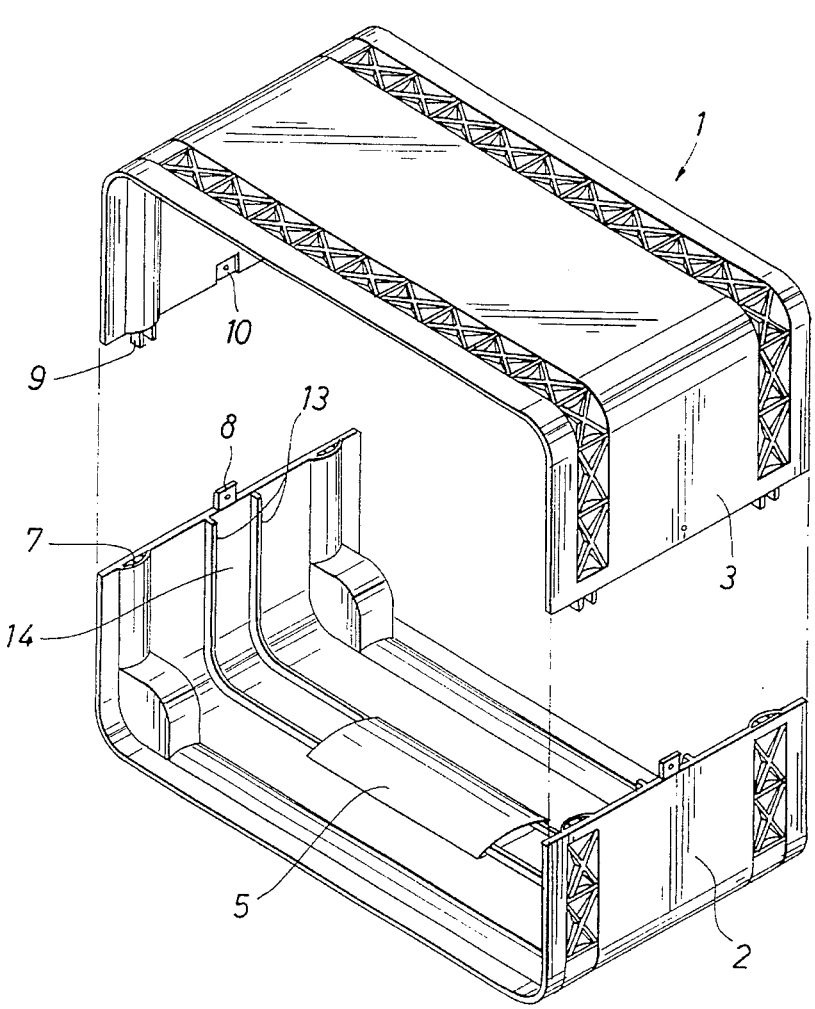
FIG. 5 a perspective view showing the engagement of the U-shaped base structure and the U-shaped upper structure.
Figure 6:
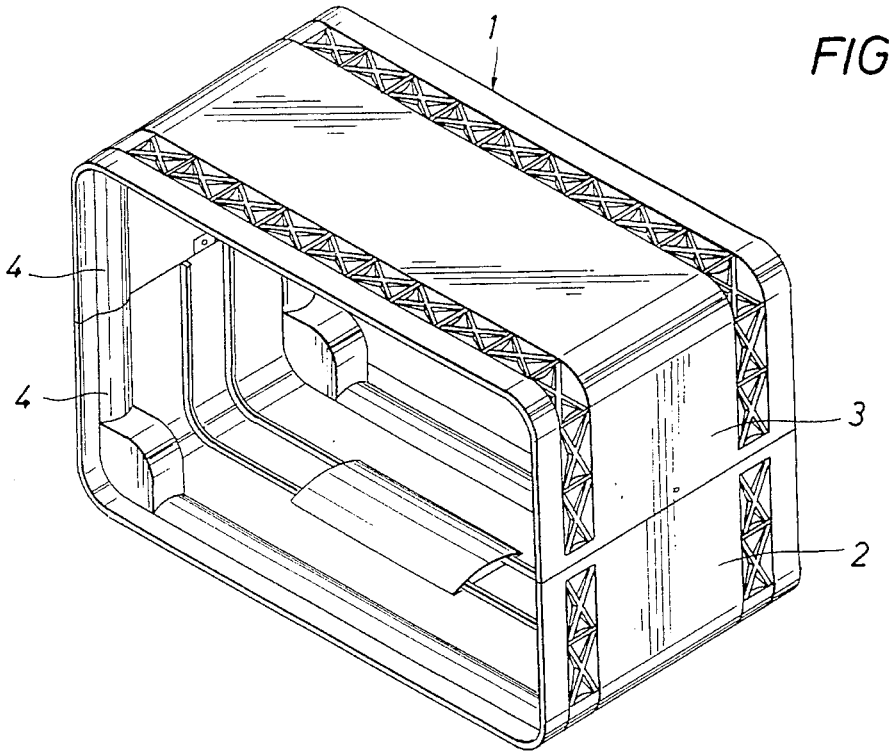
FIG. 6 is a perspective view showing a luggage frame work obtained by engaging the U-shaped base structure with the U-shaped upper structure.
Figure 7:
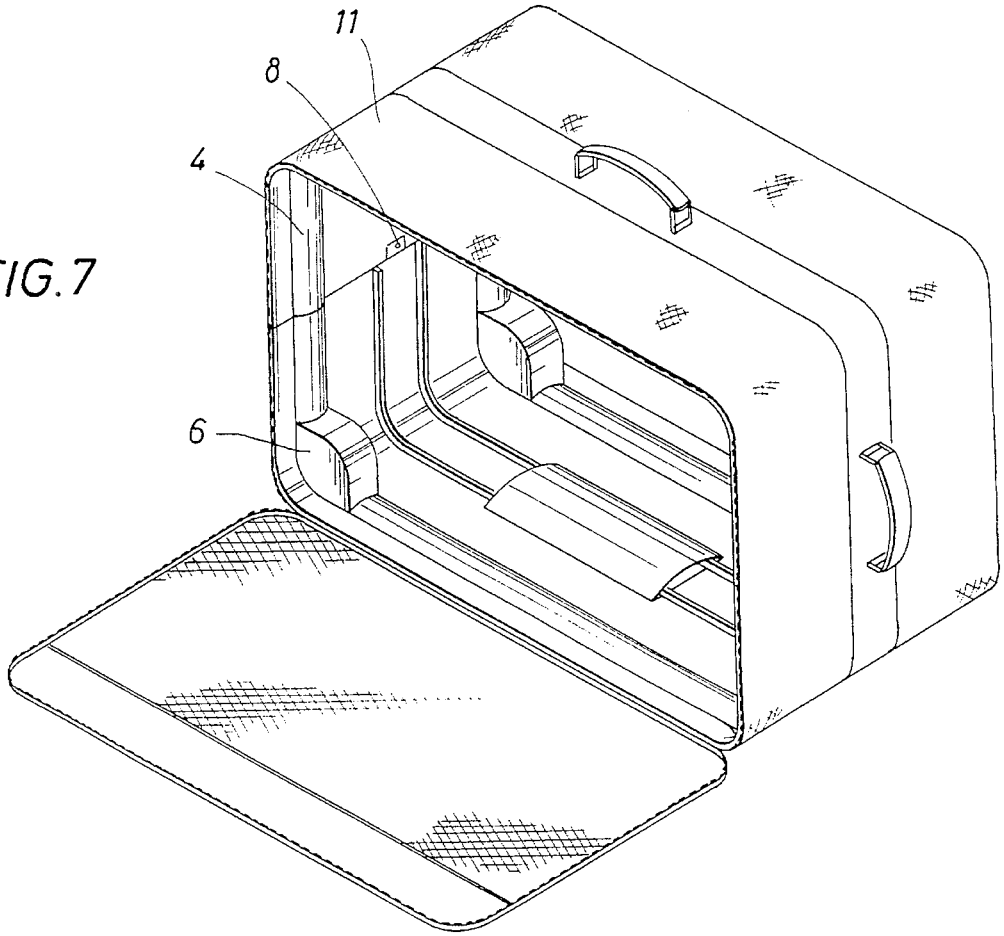
FIG. 7 is a perspective view showing the luggage frame work of the present invention combined with an exterior panel while the luggage is opened.

As shown in FIGS. 5 and 6, when the U-shaped base structure 2 and U-shaped upper structure 3 are assembled and engaged to constitute the first embodiment of the luggage frame work 1, the engaging holes 7 and connecting lock tabs 8 of the U-shaped base structure 2 can match exactly with the engaging latch rods 9 and engaging notches 10 of the U-shaped upper structure 3, respectively. The assembled luggage frame work 1 can be further enclosed by the panel 11, as shown in FIG. 7, wherein the luggage is opened.

Figure 8A:
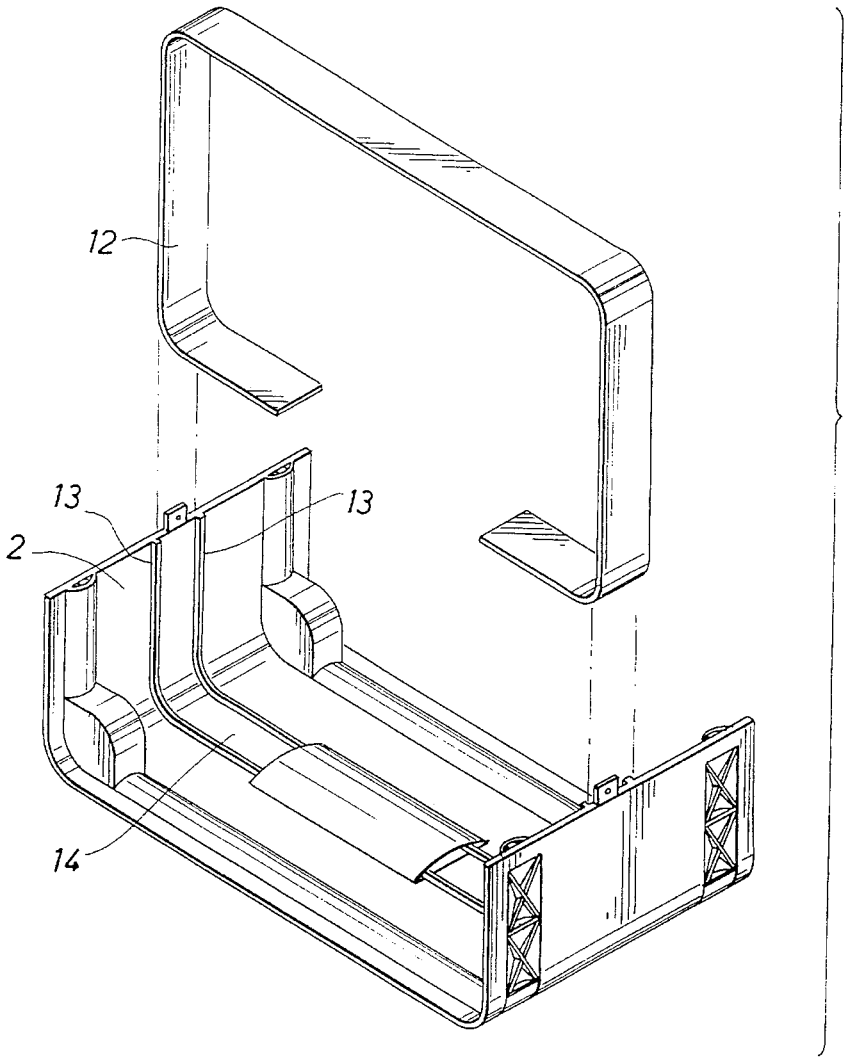
FIG. 8A is a perspective view showing the luggage frame work with disassembled U-shaped base structure and the metal frame.
Figure 8B:
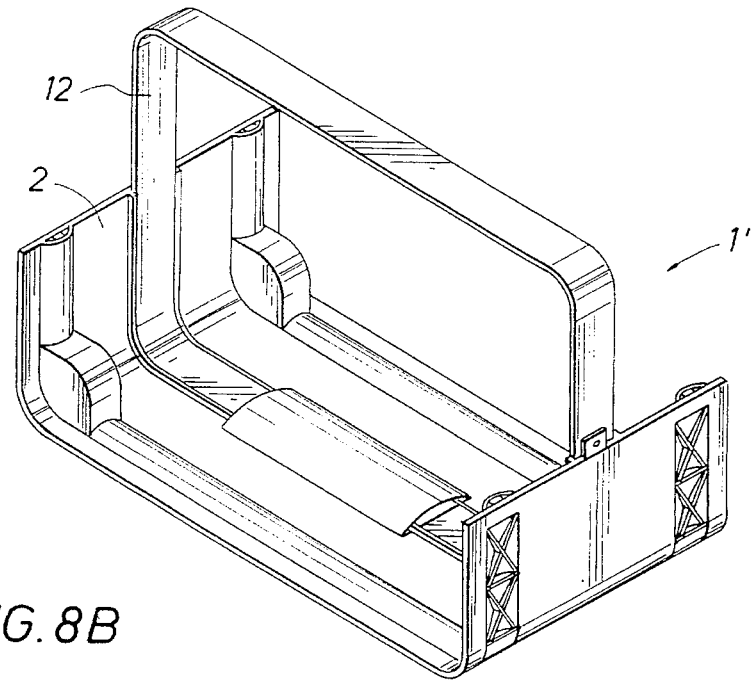
FIG. 8B is a perspective view showing the luggage frame work obtained by assembling the U-shaped base structure and the metal frame.

A second preferred embodiment of the luggage frame work 1' comprising the U-shaped base structure 2 and the metal frame 12 is shown in FIGS. 8A and 8B. In comparison with the first embodiment of the luggage frame work 1, the luggage frame work 1' employed a metal frame 12 instead of the U-shaped upper structure 3. The metal frame 12 is inserted into the guide bands 14 provided on the U-shaped base structure 2, and the two ends of metal frame 12 are received in the two ends of reinforcing band 5 of the U-shaped base structure 2 so as to form the luggage frame work 1'. The luggage frame work 1' is suitable for occasions when the rigidity requirement of the upper portion of a luggage is not severe, and/or the edges of the panel 11 need to be reinforced or supported by steel wires.

Figure 10:
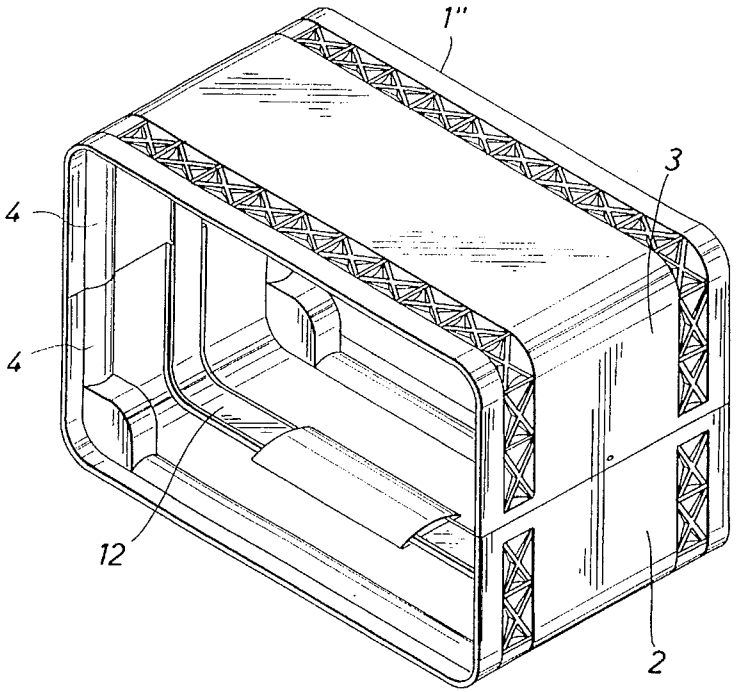
FIG. 10 is a perspective view showing the luggage frame work obtained by assembling the U-shaped base structure, the U-shaped upper structure and the metal frame.
Figure 9:
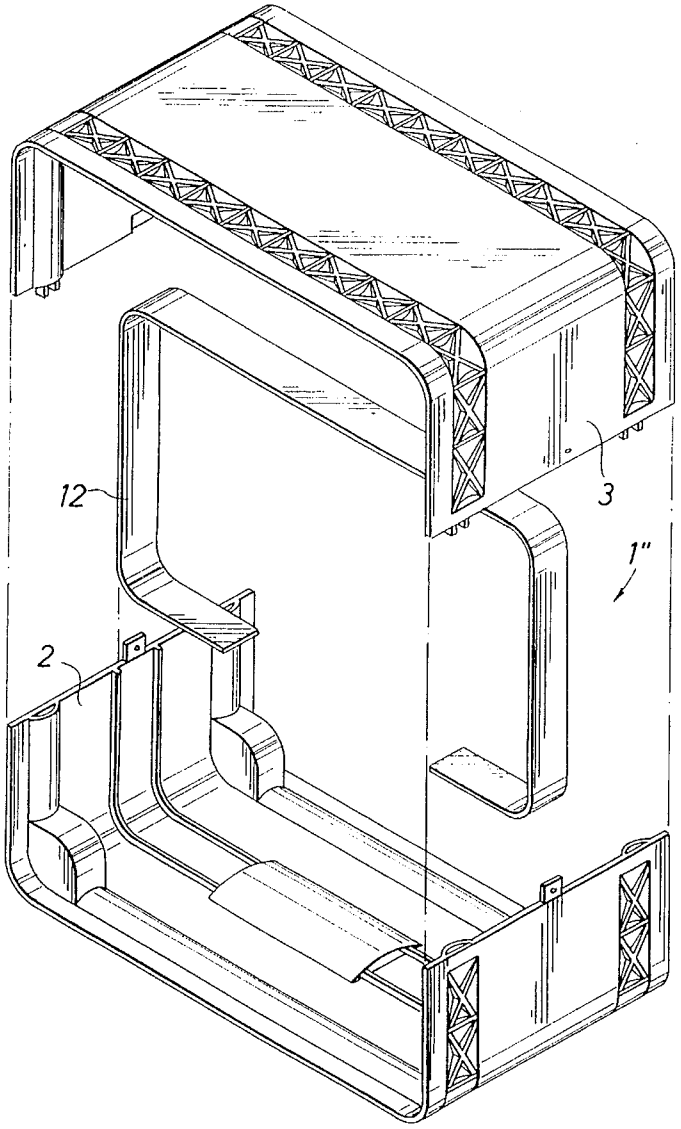
FIG. 9 is a perspective view showing the luggage frame work with the disassembled U-shaped base structure, the U-shaped upper structure and metal frame.

A third embodiment of the luggage frame work 1" comprising the U-shaped base structure 2, the U-shaped upper structure 3 and the metal frame 12 is shown in FIGS. 9 and 10. The luggage frame work 1" is formed by connecting and assembling the U-shaped base structure 2 and the U-shaped upper structure 3 as described in the first embodiment of the luggage frame work 1, and further connecting and assembling the U-shaped base structure 2 and the metal frame 12 as described in the second embodiment of the luggage frame work 1' to obtain an even stronger luggage. Such a luggage frame work 1" is especially suitable for large luggage designs.

The U-shaped base structure 2 and U-shaped upper structure 3 can be made from, for example, engineering plastic by injection molding. The reinforcing ribs 4, reinforcing band 5, small rib plates 4*a* and 5*a* and other components are all injection molded on the U-shaped base structure 2 and U-shaped upper structure 3 to obtain increased integral rigidity.

The frame works 1, 1' and 1" of the present invention can be made from standardized structural components as described above. The standardized components can be combined to form different frame works 1, 1' and 1" based on different requirements. Persons skilled in the art can make modifications to the disclosed content of the present invention, such as the number, location and shape of the reinforcing ribs, without departing the disclosed scope of the present invention.

I claim:

1. A frame work for soft-sided luggage comprising:

a U-shaped base structure having a first reinforcing rib on each of the two side edges of the interior surface of said U-shaped base structure protruding toward the interior of said luggage, each of said first reinforcing ribs having an engaging hole provided at its both ends; a reinforcing band provided on said U-shaped base structure between and parallel to said first reinforcing ribs protruding toward the interior of said luggage; each of said first reinforcing ribs and said reinforcing band having a convex surface and arc-shaped cross section; two guide grooves extending parallel to each other and to said first reinforcing ribs being provided to form one guide band in the inner surface of said U-shaped base structure at both ends of said reinforcing band; one connecting lock tab protruding at the center of each end of said U-shaped base structure; one wheel base provided on each of said reinforcing ribs at one corner of said U-shaped base structure for receiving a wheel for trailing said luggage; and a U-shaped upper structure having a second reinforcing rib on each of the two side edges of the interior surface of said U-shaped upper structure having a convex surface protruding toward the interior of said luggage and having arc-shaped cross section, each of said second reinforcing ribs having an engaging latch rod provided at its both ends; one engaging notch being provided at the center of each end of said U-shaped upper structure;

wherein small rib plates are provided at the back of said convex surfaces of said first and second reinforcing ribs and said reinforcing band, and said engaging holes and said connecting lock tabs of said U-shaped base structure are engaged with said engaging latch rods and said engaging notches of-said U-shaped said upper structure, respectively.

2. The frame work for soft-sided luggage of claim 1 wherein each of said connecting lock tabs and said engaging notches is provided with a rivet hole for rivet-engagement.

3. The framework for soft-sided luggage of claim 1 wherein said U-shaped base structure and said U-shaped upper structure are formed of injection-molded plastic.

4. A frame work for soft-sided luggage comprising:

a U-shaped base structure having a first reinforcing rib on each of the two side edges of the interior surface of said U-shaped base structure protruding toward the interior of said luggage, each of said first reinforcing ribs having an engaging hole provided at its both ends; a reinforcing band provided on said U-shaped base structure between and parallel to said first reinforcing ribs protruding toward the interior of said luggage; each of said first reinforcing ribs and said reinforcing band having a convex surface and arc-shaped cross section; two guide projections extending parallel to each other and to said first reinforcing ribs being provided to form one guide band in the inner surface of said U-shaped base structure at both ends of said reinforcing band; one connecting lock tab protruding at the center of each end of said U-shaped base structure; one wheel base provided on each of said reinforcing ribs at one corner of said U-shaped base structure for receiving a wheel for trailing said luggage; small rib plates provided at the back of said convex surfaces of said first reinforcing rib and said reinforcing band; and a metal frame inserted into said guide bands, and the two ends of said metal frame being received in the two ends of said reinforcing band.

5. The framework for soft-sided luggage of claim 4 wherein said U-shaped base structure is formed of injection molded plastic.

6. A frame work for soft-sided luggage comprising:

a U-shaped base structure having a first reinforcing rib on each of the two side edges of the interior surface of said U-shaped base structure protruding toward the interior of said luggage, each of said first reinforcing ribs having an engaging hole provided at its both ends; a reinforcing band provided on said U-shaped base structure between and parallel to said first reinforcing ribs protruding toward the interior of said luggage; each of said first reinforcing ribs and said reinforcing band having a convex surface and arc-shaped cross section; two guide grooves extending parallel to each other and to said first reinforcing ribs being provided to form one guide band in the inner surface of said U-shaped base structure at both ends of said reinforcing band; one connecting lock tab protruding at the center of each end of said U-shaped base structure; one wheel base provided on each of said reinforcing ribs at one corner of said U-shaped base structure for receiving a wheel for trailing said luggage;

a metal frame inserted into said guide bands, and the two ends of said metal frame being received in the two ends of said reinforcing band; and a U-shaped upper structure having a second reinforcing rib on each of the two side edges of the interior surface of said U-shaped upper structure having a convex surface protruding toward the interior of said luggage and having arc-shaped cross section, each of said second reinforcing ribs having an engaging latch rod provided at its both ends; one engaging notch being provided at the center of each end of said U-shaped upper structure;

wherein small rib plates are provided at the back of said convex surfaces of said first and second reinforcing ribs and said reinforcing band, and said engaging holes and said connecting lock tabs of said U-shaped base structure are engaged with said engaging latch rods and said engaging notches of said U-shaped said upper structure, respectively.

7. The frame work for soft-sided luggage of claim 6 wherein each of said connecting lock tabs and said engaging notches is provided with a rivet hole for rivet-engagement.

8. The framework for soft-sided luggage of claim 6 wherein said U-shaped base structure and said U-shaped upper structure are formed of injection-molded plastic.

* * * * *